US011512520B1

(12) United States Patent
Gray et al.

(10) Patent No.: US 11,512,520 B1
(45) Date of Patent: Nov. 29, 2022

(54) EMERGENCY EVACUATION CONTAINER AND SERVICE FOR PROTECTION OF VALUABLES

(71) Applicant: UIPCO, LLC, San Antonio, TX (US)

(72) Inventors: Emily Margaret Gray, San Antonio, TX (US); Brian Francisco Shipley, Plano, TX (US); Justin Dax Haslam, San Antonio, TX (US); Robert Wiseman Simpson, Fair Oaks Ranch, TX (US); Donnette L. Moncrief Brown, San Antonio, TX (US); Eric David Schroeder, San Antonio, TX (US); Michael J. Maciolek, Boerne, TX (US); Bobby Lawrence Mohs, San Antonio, TX (US); Manfred Amann, San Antonio, TX (US); Rochelle Ann Tijerina, San Antonio, TX (US); Meredith Beveridge, Denver, CO (US)

(73) Assignee: United Services Automobile Association (USAA), San Antonio, TX (US)

( * ) Notice: Subject to any disclaimer, the term of this patent is extended or adjusted under 35 U.S.C. 154(b) by 171 days.

(21) Appl. No.: 17/082,942

(22) Filed: Oct. 28, 2020

Related U.S. Application Data

(60) Provisional application No. 62/927,510, filed on Oct. 29, 2019.

(51) Int. Cl.

| | |
|---|---|
| ***E05G 1/00*** | (2006.01) |
| ***G07C 9/33*** | (2020.01) |
| ***E05B 65/00*** | (2006.01) |
| ***G08B 25/00*** | (2006.01) |

(52) U.S. Cl.
CPC ..... *E05G 1/005* (2013.01); *E05B 65/0075* (2013.01); *G07C 9/33* (2020.01); *G08B 25/003* (2013.01)

(58) Field of Classification Search
CPC ..... E05G 1/005; G07C 9/33; E05B 65/0075; G08B 25/003
See application file for complete search history.

(56) References Cited

U.S. PATENT DOCUMENTS

2002/0172572 A1* 11/2002 Holt ..... B63B 25/28 410/115
2006/0216966 A1* 9/2006 Selek ..... B60P 1/6418 439/76.2
2012/0158606 A1* 6/2012 Moudy ..... G06Q 10/083 705/332
2016/0284149 A1* 9/2016 Espig ..... G07C 9/00182
2019/0164368 A1* 5/2019 Ruth ..... E05G 1/005

* cited by examiner

*Primary Examiner* — Sisay Yacob
(74) *Attorney, Agent, or Firm* — Plumsea Law Group, LLC

(57) ABSTRACT

A container for the storage of valuables and a service to retrieve the container is disclosed. The container is designed to contain valuables and important documents, and protect these contents during an emergency evacuation situation. The container is waterproof and can float in water. The container can also be made of a flame-resistant material. The container can emit a homing signal to facilitate the retrieval of the container in the event of an emergency situation. A container retrieval service can initiate a retrieval of the container in response to a determination that a disaster is likely to occur in the region where the container is located.

20 Claims, 11 Drawing Sheets

EMERGENCY EVACUATION CONTAINER AND SERVICE FOR PROTECTION OF VALUABLES

CROSS-REFERENCE TO RELATED APPLICATION

This application claims the benefit of U.S. Provisional Patent Application Ser. No. 62/927,510 filed on Oct. 29, 2019 and titled "Emergency Evacuation Container and Service for Protection of Valuables", the disclosure of which is incorporated by reference in its entirety.

TECHNICAL FIELD

The present disclosure generally relates to containers and in particular, to containers that protect a person's valuables and transmit a signal during emergency situations.

BACKGROUND

Severe weather, natural disasters, fires and other extreme conditions can force the evacuation of large numbers of people. Often, people are unprepared for evacuation, and in the urgent rush to evacuate with family members and pets, important objects and documents can be left behind and eventually destroyed.

There is a need in the art for a container that can protect valuables and important documents during an emergency situation and a service for locating and securing these containers.

SUMMARY

In one aspect, a method of securing items in anticipation of a disaster includes providing a container to a first end-user, and receiving and recording a registration of the container from the first end-user. The method also includes determining that a region in which the container is located is likely to experience an emergency situation, and in response to this determination, dispatching a transport vehicle to a first location to retrieve the container. Furthermore, the method includes retrieving and transporting the container to a secure facility designed to protect and safeguard the container.

In another aspect, a system for protecting and securing a container located in a region that is likely to be affected by a disaster includes a processor and machine-readable media including instructions which, when executed by the processor, cause the processor to receive and record a registration of the container from the first end-user, receive information about a disaster in the region, and then, in response to the information, dispatch a transport vehicle to a first location to retrieve and transport the container to a secure facility designed to protect and safeguard the container.

In another aspect, a container for the secure storage of items in anticipation of a disaster, includes a housing unit having an interior space defined by a plurality of outer walls, a resealable closing system formed in the housing unit providing access to the interior space, and a beacon configured to emit a location signal. The container further includes a secured access system associated with an exterior surface of at least a first outer wall. The secured access system is configured to verify an identity of the specific user intending to access the interior space once the container is sealed, based upon at least one of the following: (a) a PIN entered by the user; (b) a biometric identification; (c) a key inserted into a lock mechanism; and (d) an RFID signal.

Other systems, methods, features, and advantages of the disclosure will be, or will become, apparent to one of ordinary skill in the art upon examination of the following figures and detailed description. It is intended that all such additional systems, methods, features, and advantages be included within this description and this summary, be within the scope of the disclosure, and be protected by the following claims.

BRIEF DESCRIPTION OF THE DRAWINGS

The disclosure can be better understood with reference to the following drawings and description. The components in the figures are not necessarily to scale, emphasis instead being placed upon illustrating the principles of the invention. Moreover, in the figures, like reference numerals designate corresponding parts throughout the different views.

DESCRIPTION OF EMBODIMENTS

The following embodiments provide a container apparatus that can store and protect valuables during an emergency situation, as well as a service and method to retrieve and secure such containers. Emergency situations as used herein refer to situations that are caused by natural disasters such as hurricanes or wildfires, as well as accidents and other man-caused disasters. The disclosed containers may allow a user to safely store items, and in case of emergency, offer a readily available means of securing the items. For example, in some instances, an emergency situation may cause an unsafe environment such as flooding or fires. The container may allow the stored items to remain protected from water and/or fire. In some situations where flooding may occur, some embodiments of the system may provide a waterproof vessel for items in the container to remain dry and float. In other embodiments, the container may include a beacon that signals rescuers of its location. In addition, a service may deploy a vehicle to retrieve and hold the container in safekeeping in response to emergency situations, freeing the owner to focus on the safety of their own person and family. In some embodiments, the container system may include biometric locks to ensure only the original user can access its contents. Such a system may facilitate the preservation of the user's belongings and the integrity of their property.

Figure 1:
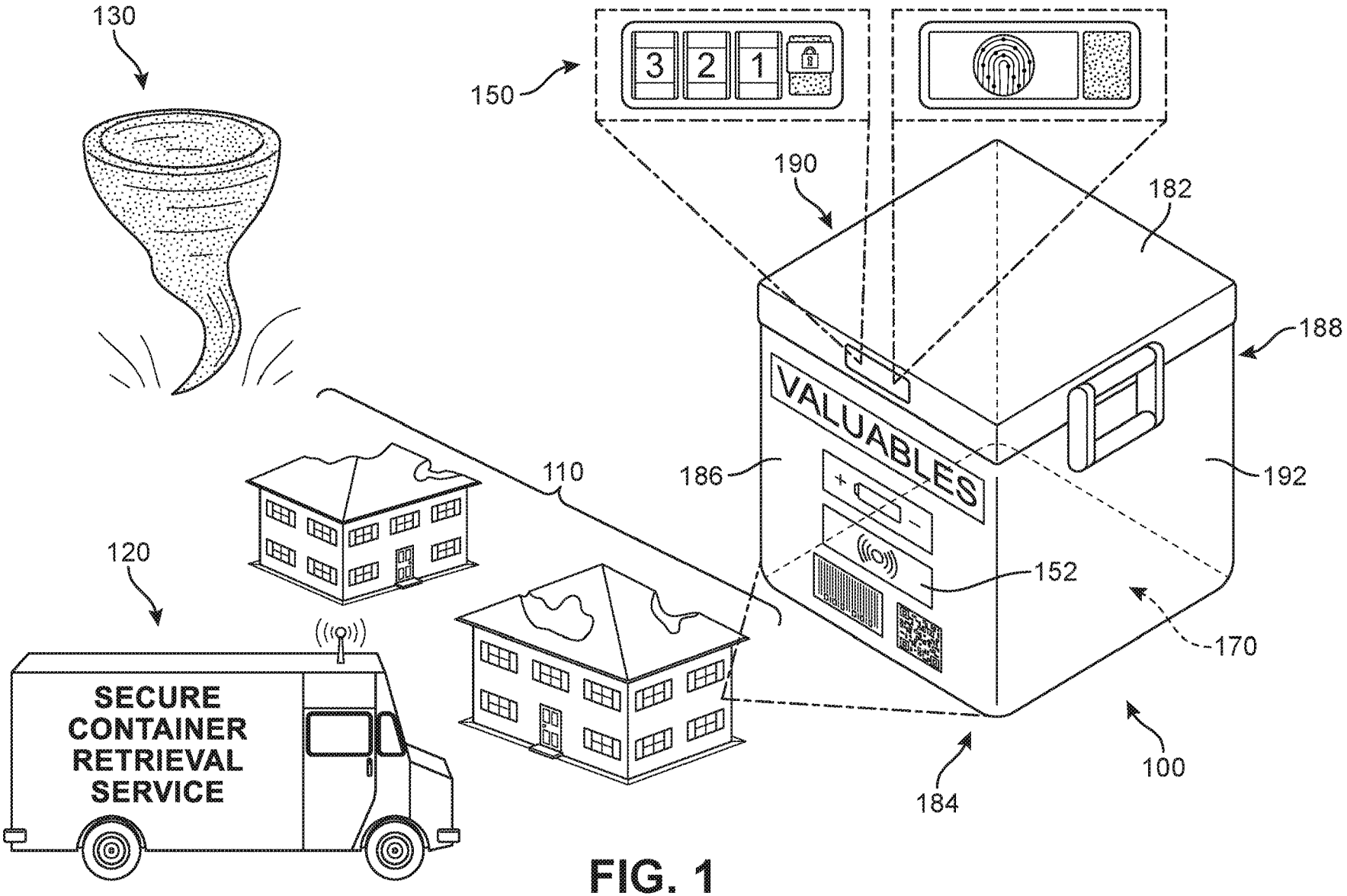
FIG. 1 is an example of a container and a deployment of a vehicle to retrieve the container in response to an emergency situation, according to an embodiment.

For purposes of clarity, an overview of one embodiment of the proposed systems and methods is illustrated with reference to FIG. 1. In FIG. 1 an embodiment of a container 100 is depicted in a scenario in which an emergency situation 130 has occurred. The container 100 was stored in a residence 110 and, following a natural disaster, the residence 110 was heavily damaged. While the family who lived in residence 110 had evacuated to safety, they were forced to leave behind most of their valuables. However, because they had previously arranged to store their most important valuables in the portable container 100, those contents remained undamaged and protected. Following the disaster, a container retrieval service ("service") 120 has been deployed to locate and retrieve the container 100. In this case, the container also emits a signal, such as a telemetry or homing signal, to help guide the service 120 to the location of the container 100.

Container 100 may be configured to be any shape or size. Referring to FIG. 1, container 100 shown has a generally rectangular three-dimensional or cuboid shape. However, it should be kept in mind that the principles of the invention can apply to a container having any shape or size, including other regular and irregular geometric shapes, or containers that have hard, rigid sides and retain their shape, or soft, yielding sides such that the shape changes or flexes depending on the contents of the container or other forces applied to the container.

In different embodiments, the container 100 can include an external housing unit with a perimeter having one or more edges. For example, a container 100 may include at least two outer panels or walls that include a perimeter. The term "outer wall" is used to generally describe the external housing or outermost structural panels of the container. It is not intended to imply that the sides of the container are necessarily rigid or flat. In FIG. 1, the container 100 includes a plurality of outer walls 140 that form a housing unit providing, forming, defining, or otherwise bounding an interior volume, void, or space 170. The container 100 of FIG. 1 includes an upper wall 182 or lid, a bottom wall 184 or base, a forward wall 186, a rear wall 188, a first side wall 190, and a second side wall 192. In some embodiments, two or more outer walls may be permanently joined on multiple edges. In this specification and claims, "permanently joined" means that the walls can only be separated by destructive separation of one or both walls, or the joint must be damaged or destroyed to fully separate the first wall from the second wall at that location.

In some embodiments, one outer wall or a portion thereof can be hingedly or releasably connected or fastened to the remaining part of the wall or walls of the housing unit that are integrally joined together, providing a resealable closing system. For example, a portion of the housing can include a door, seal, or lid that permits a resealable opening through which the interior space 170 may be accessed and items may be added or removed. In this case, the upper wall 182 is a lid that includes a peripheral border portion that extends or protrudes out to 'meet' the upper edges of forward wall 186, rear wall 188, first side wall 190, and second side wall 192. The space 170 can be configured to receive or hold a plurality of valuable items ("valuables"). For example, in FIG. 1, the valuables may include photos, personal or legal documents such as a will, jewelry, heirlooms, mementos, passwords, hard drives, antiques, and other valuables. Such items would not be easily replaceable following a disaster.

Furthermore, as noted above, in some embodiments, the container 100 can include a locking mechanism or other secured access system 150 for securing the items 160 within the container 100. In some embodiments, the secured access system 150 or portions thereof can be associated or attached to an exterior or outwardly facing surface of an outermost wall or lid of the container 100. For example, the secured access system 150 may be configured to verify an identity of the specific user intending to access the interior space once the container is sealed, based upon a PIN entered by the user, a biometric identification, a key inserted into a lock mechanism, and/or an RFID signal. Thus, in some embodiments, the container 100 can be configured to restrict access to the interior of container 100 only to persons authorized to have such access (see FIG. 4 below). In addition, in some embodiments, the container 100 can include a tracking device or beacon 152 configured to relay a signal indicating the location of the container or a preprogrammed route or map to the container or another specified location.

Figure 2:
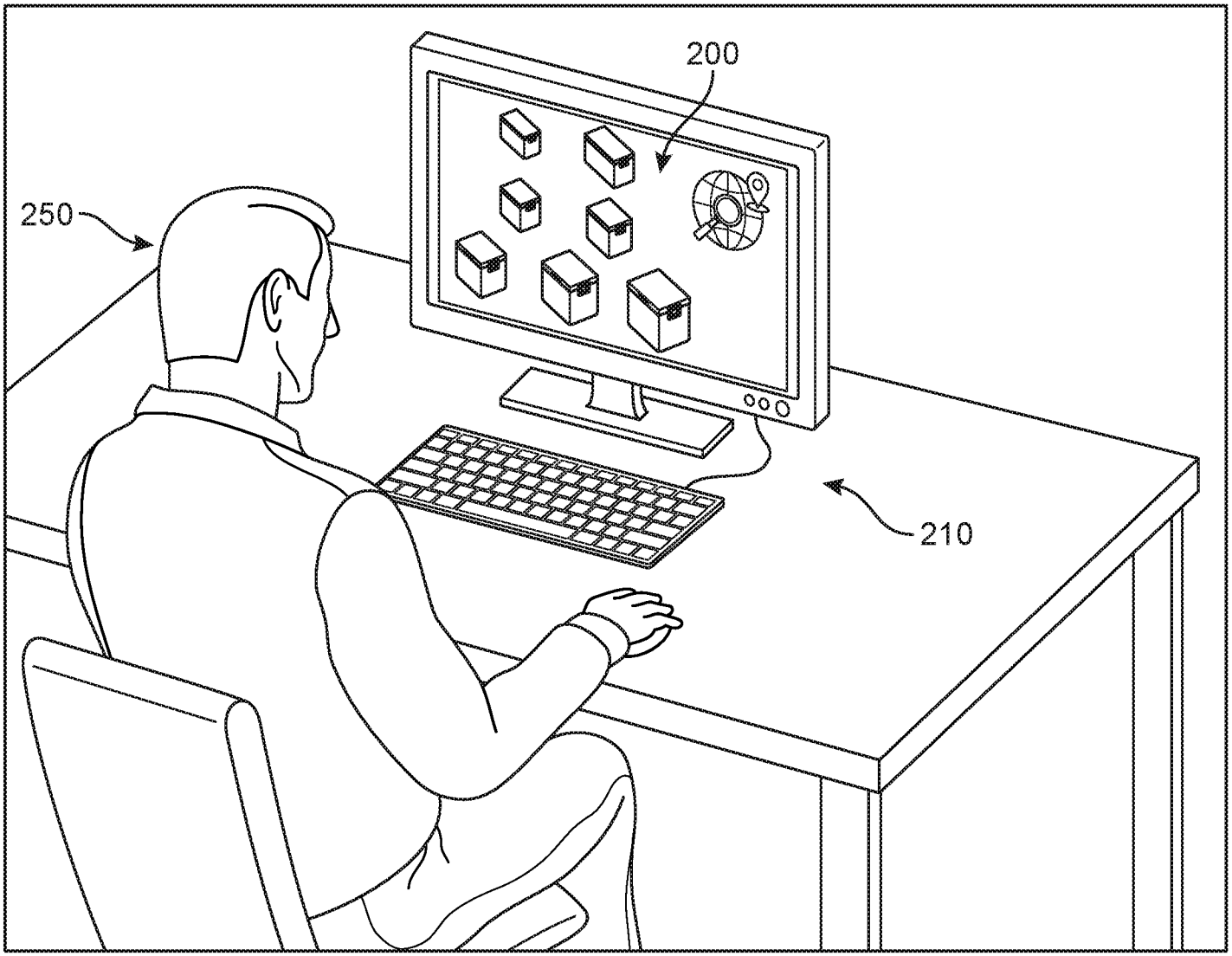
FIG. 2 is an example of a user perusing container options via an online retailer, according to an embodiment.
Figure 3:
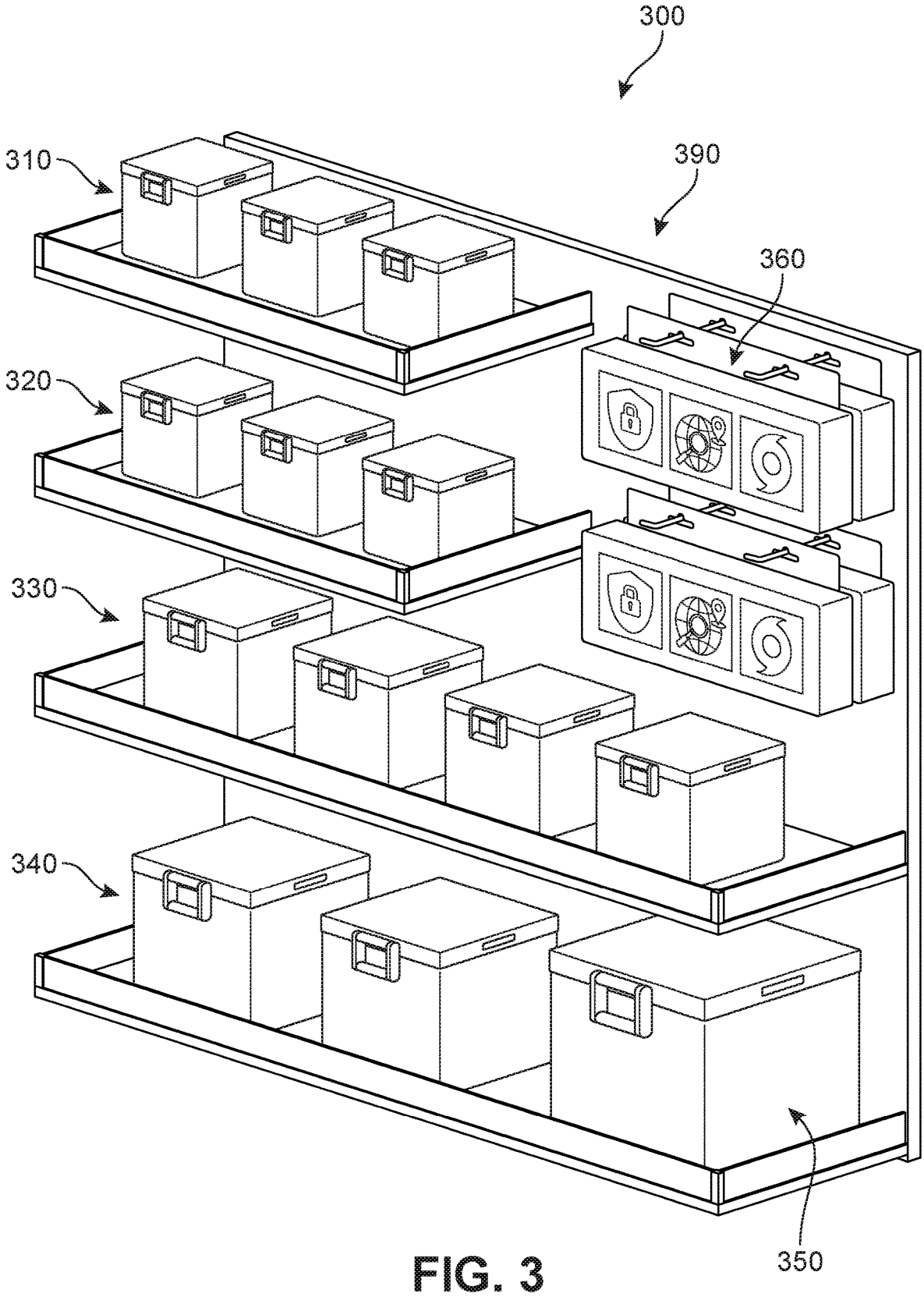
FIG. 3 is an example of an in-store merchandise display presenting different container options, according to an embodiment.

FIGS. 2 and 3 present two example scenarios by which a consumer may obtain a container. In FIG. 2, various container options 200 are displayed to a consumer 250 via a display of a computing device 210, and in FIG. 3, a plurality of containers 300 are on display on shelves at a retail store 390. In both FIGS. 2 and 3, the containers include a range of dimensions, sizes, and volumes. For example, in FIG. 3, a range of container sizes includes a first size 310, a second size 320, a third size 330, and a fourth size 340, and a fifth size 350, here identified in order of smallest to largest. Other sizes and shapes not shown can be offered, and in some embodiments, a customer may be able to custom order a specific type of box shape or size to accommodate their own storage needs. Furthermore, some containers can include one type of secured access system such as a lock and key, and other containers can include biometric-dependent access seals, while other containers may include multiple types of security mechanisms. In another example, the container can include a secured access system that is configured to connect to a mobile device and allow a user to submit authentication tokens via a mobile app that are transmitted to a lock-unlock function on the container.

In some embodiments, the containers can be configured to be readily stackable, such that a user may obtain multiple containers and stack several containers in a stable tower, or allow the containers to be cleanly nested within one another when not in use. For example, the containers may be offered in ×1, ×½ and ×¼ unit sizes or other such readily expandable sizes. In different embodiments, the containers can be offered for sale through an online vendor, or at a retail location, such as a retail store, kiosk, factory outlet, or manufacturing store. In some cases, government organizations or other agencies may offer containers to the general public in anticipation of an emergency situation.

In some embodiments, containers may include identification features disposed on an exterior surface. The identification features may allow a user to identify their own container. Some examples of an identification mark can include; a barcode, alphanumerical code, label, icon, or quick response (QR) code. In other embodiments, any other kind of identifier or indicia could be used with the container. Some embodiments of the container can include multiple identification marks. In addition, in cases where a container is obtained online, the vendor may also provide a pre-registration service by which the user can establish a profile for their container(s). For example, a user can identify the primary address and owner of the container, their preferences for pick up or storage during a disaster, how specific items in the container should be handled in the event that the owner is not found or is unable to indicate their wishes, and/or a listing of other persons who are authorized to access or take custody of the container. Such a system can also pre-link the container's identification mark to the new owner, generating a record that will ensure the container's owner can always be identified and the owner's corresponding preferences readily determined. In another example, the pre-registration may allow a user to select a desired locking mechanism, be provided with a pre-assigned lock code, or link their own biometric data to the container profile such that the container is accessible only by that user even before the user has received the container. In yet another example, the user can receive a code to register the container via a mobile device software application, whereby the container profile can be created, modified, or updated, the location of the container can be displayed, or other information, including a password or other security token for accessing the profile or opening the container can be managed.

In some embodiments, a user may desire the services associated with the containers (e.g., location tracking, profile recording, retrieval during a disaster, and/or secure storage service until the user can return for the container) but not wish to use the containers currently being sold, and/or the user may feel the process of transferring their valuable items from their present location to the container is too challenging. In such cases, the retail system may offer an add-on or modification option by which the user can order or purchase a preconfigured and preregistered device that may be installed on a user-designated item or item(s). For example, in FIG. 3, a mod-kit 360 can include a tracking device, biometric security system, installation equipment and tools, and/or registration instructions to enable a user to incorporate the desired service to a pre-existing container or object.

Figure 4:
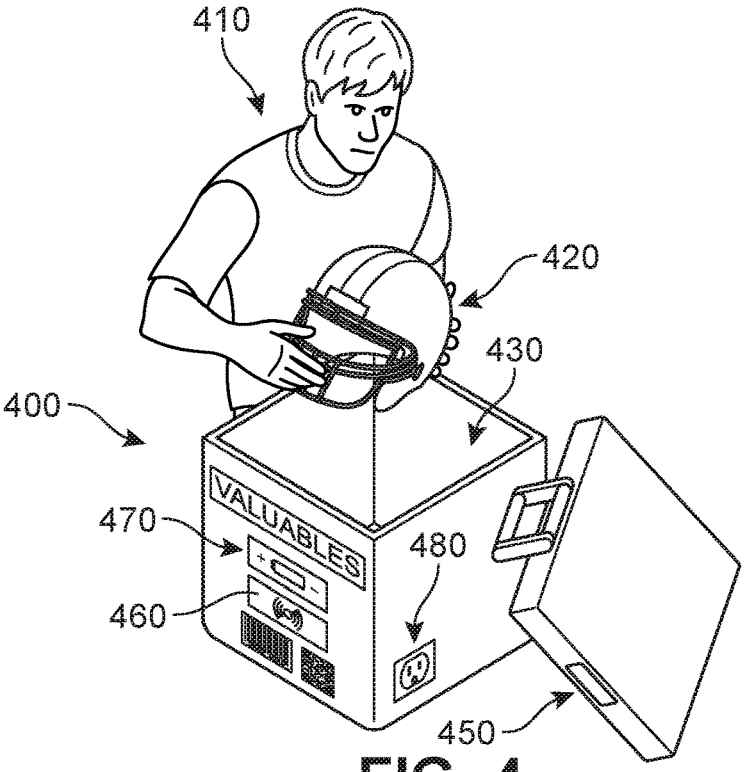
FIG. 4 is an example of a person storing valuables in a container, according to an embodiment.

Referring now to FIG. 4, an embodiment of an opened or unsealed container 400 is shown, with a first user 410 depositing a first item 420 into an interior void 430 of the container 400. In some embodiments, the interior void 430 may include compartmental features such as various pockets, shelves, dividers, or other organizational or structural features for storing different items. In some embodiments, the interior void 430 may include one or more pockets or recesses that can be disposed on or formed in an interior-facing surface of container 400.

Furthermore, as noted above, a container may include various mechanisms and systems for accessing and/or securing the contents stored in the interior void 430. A secured access system 450 can be configured to communicate and/or respond to, for example, signals emitted by near field communication (NFC) technology via a proximity sensor, for example, or an input mechanism (e.g., an Interactive display or keypad) for receiving input from a user to verify his or her identity or authority to access the container, by, for example, entering a PIN or a VIP code. In some embodiments, an interactive display may issue these instructions visibly on display. A VIP code is a code—often a numeric code—that is transmitted to a device held or viewed by the user and that is only valid for a short period, such as 30 seconds or a few minutes. It may alternatively issue these instructions audibly via a speaker incorporated into the container housing. The user's identity may also or alternatively be verified by biometric scanner, which could include, for example, using facial recognition based upon the user's facial features, voice recognition based upon a voiceprint of the user, a retinal scan and/or fingerprint identification.

In addition, as noted above, some embodiments may include provisions for tracking or otherwise locating or determining a route to a container. In some embodiments, a container could be provided with a tracking beacon (or tracking device), such as tracking beacon 460. Different kinds of tracking beacons could be used, including bluetooth enabled tracking beacons, WiFi enabled tracking beacons, cellular enabled tracking beacons, GPS enabled tracking beacons or any other kinds of tracking beacons. Generally, the type of tracking beacon used may be selected to optimize the range of tracking and the power needs of the beacon. For example, blue tooth enabled beacons may have low power consumption but may only be detectable in a limited range. Various kinds of GPS enabled tracking systems may facilitate tracking over a longer range but may consume significant power. In some embodiments, a tracking beacon could be incorporated into the interior void 430 of the container 400 or integrated or attached to a surface of its housing.

In different embodiments, a container can include a power source, such as an onboard battery 470. The onboard battery 470 may be charged by connection of an electrical source 480 to an outlet and/or a solar panel (not shown) that may be installed on an outer wall of the container. In some embodiments, the onboard battery 470 may be any kind of battery known in the art. For example, onboard battery 470 could be a rechargeable lithium-ion battery. In embodiments where onboard battery 470 is rechargeable, power for recharging it could be supplied by a solar panel. In other embodiments, a non-rechargeable battery could be used. Onboard battery 470 may be used to power a variety of different items, including a user's cell phone or other device, as well as to provide power to tracking beacon 460. If an electronic locking system is used, such as a fingerprint reader or display, the battery 470 could also be used to power the such systems. The user can store the container in a charging mode until the container is moved to ensure the power supply remains full prior to any emergency situation.

As noted above, embodiments are not limited to the particular size and shape of container 400. In other embodiments, other types of containers could be used. For example, a container may include straps so that container may be worn as a backpack. In other embodiments, other types of containers could be provided, including shoulder bag containers, hand-held containers, duffle bag containers, rolling containers, compactable containers, as well as others.

Figure 5:
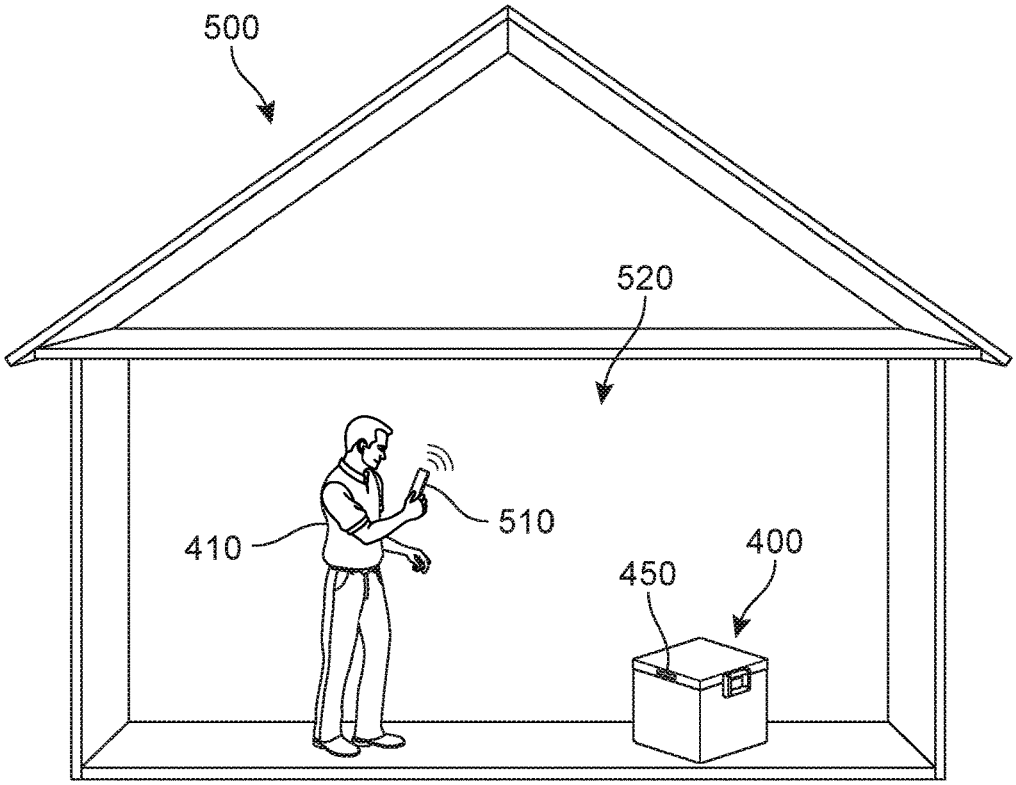
FIG. 5 is an illustration of a person registering the location of the container, according to an embodiment.

In FIG. 5, the first user 410 is shown having completed the packing of container 400 and placing the container 400 in a room 520 at his residence 500. In other examples, the first user 410 may transport the container 400 to other locations, such as outside, in a shed, at work, in his or her car, at a friend's home, or any other location. The first user 410 may choose to update or create a new profile for his container, for example via a mobile device 510, which will be stored in a cloud service associated with the container retrieval system. In addition, in some embodiments, the mobile device 510 may communicate with the secured access system 450 to access or adjust settings of the container 400. In another example, a user may submit an access request to a remote server over a communications medium such as the Internet using a mobile device such as a smartphone. In the embodiment shown in FIG. 5, the secured access system 450 communicates with mobile device 510 over, for example, a wireless near field communication system or NFC system. The identity of first user 410 may be verified by secured access system 450, based upon a password or code. It may also be based upon biometric identification such as a fingerprint, a retinal scan, voice recognition, or facial recognition.

Once the container 400 has been packed and sealed, it may remain so indefinitely, or be opened and accessed and items exchanged regularly by the owner. However, in the event of an emergency situation, the container 400 includes provisions for ensuring the items stored within are protected from external forces and elements, with the assumption that the location of the container 400 (such as residence 500) will not provide such protection. For example, some embodiments can include provisions that protect the contents of container in high temperature or fire conditions. In one embodiment, some or all exterior or outermost (exposed) portions of the container 400 can include a flame-resistant layer or coating. In some embodiments, flame-resistant layers may also be waterproof, such that the interior void of the container 400 remains dry when the container is immersed in liquid. Some embodiments can include provisions to increase the buoyancy of container 400 and/or to help to orient container 400 in water without human intervention, for example such that solar cells of a solar panel attached to the container are exposed upwards toward the sun while the opposite side of the container is generally submerged, allowing the solar cells to generate electricity. Container 100 can achieve this position automatically and without human intervention. In some embodiments, some or all portions of outer walls are buoyant or inflate upon contact with, submersion, and/or immersion in water.

Figure 6:
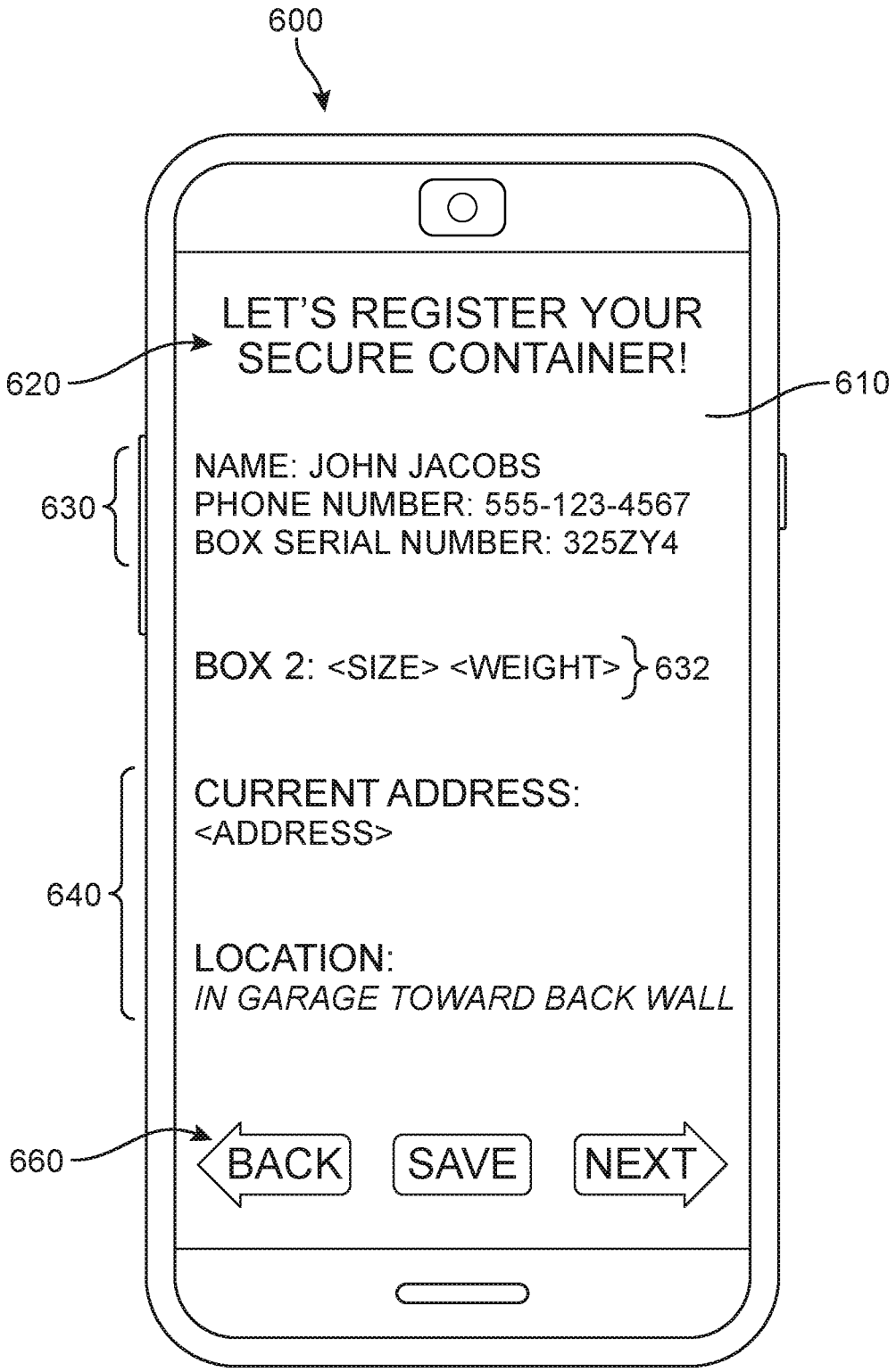
FIG. 6 is an example of a user interface for registering a container with a retrieval service, according to an embodiment.

As noted earlier, in some embodiments, an end-user can interact with and adjust settings associated with the proposed systems remotely. FIG. 6 presents an example of a representative registration and profile interface 610 ("interface") for implementing a container retrieval and protection system. In some embodiments, an application may be available that connects a user's device (for example, via a WiFi or cellular connection) with an online service provider to change the settings stored in the cloud, and automatically update the corresponding settings and information. The application can be accessed via any user computing device configured for connection to a network.

In FIG. 6, an example of interface 610 is presented on a touchscreen display of a mobile device 600 offering content via native controls included in the interface 610. Throughout this application, an "interface" may be understood to refer to a mechanism for communicating content through a client application to an application user. In some examples, interfaces may include pop-up windows that may be presented to a user via native application user interfaces (UIs), controls, actuatable interfaces, interactive buttons or other objects that may be shown to a user through native application UIs, as well as mechanisms that are native to a particular application for presenting associated content with those native controls. In addition, the terms "actuation" or "actuation event" refers to an event (or specific sequence of events) associated with a particular input or use of an application via an interface, which can trigger a change in the display of the application. This can include selections or other user interactions with the application, such as a selection of an option offered via a native control, or a 'click', toggle, voice command, or other input actions (such as a mouse left-button or right-button click, a touchscreen tap, a selection of data, or other input types). Furthermore, a "native control" refers to a mechanism for communicating content through a client application to an application user. For example, native controls may include actuatable or selectable options or "buttons" that may be presented to a user via native application UIs, touch-screen access points, menus items, or other objects that may be shown to a user through native application UIs, segments of a larger interface, as well as mechanisms that are native to a particular application for presenting associated content with those native controls. The term "asset" refers to content that may be presented in association with a native control in a native application. As some non-limiting examples, an asset may include text in an actuatable pop-up window, audio associated with the interactive click of a button or other native application object, video associated with a teaching user interface, or other such information presentation In some embodiments, the interface 610 can include a welcome or header message 620, as shown in FIG. 6 ("Let's Register Your Secure Container!"). In addition, a plurality of data input fields can also be presented. Some non-limiting examples of such fields are shown in FIG. 6, including a first set of fields 630 directed to identification of the container and its owner (e.g., name, phone number, serial number of the container), a second set of fields 632 about the container once packed (e.g., size, weight, etc.), and a third set of fields 640 regarding the location of the container (e.g., current address of the container and notes about its specific location ("In garage toward back wall")). In addition, the interface 610 can provide a plurality of selectable options, such as navigation options 660 (e.g., "Back", "Save", "Next"), or additional menu options for accessing other features or aspects of the profile.

It should be understood that the text and specific wording shown in the figures are for purposes of illustration only and in no way limit the manner by which the application may communicate or receive information. In addition, in other embodiments, one or more options or other fields and text may appear differently and/or may be displayed or generated anywhere else on the screen(s) associated with the client's system, including spaced apart from, adjacent to, or around the user interface. In other words, the figures present only one possible layout of the interface, and do not in any way limit the presentation arrangement of any of the disclosed features.

Furthermore, in some embodiments, the registration system may enable the user to enter various additional pieces of personal information that may be relevant to the care of the contents of their container, or special circumstances regarding its location or pick-up. As another example, the user may enter the names of family members or other persons that are authorized to access the container. Once all relevant information has been provided, the user may press "NEXT", "SAVE", or otherwise finalize their registration. In some embodiments, this registration process can also be performed over the phone with a service representative.

Figure 7:
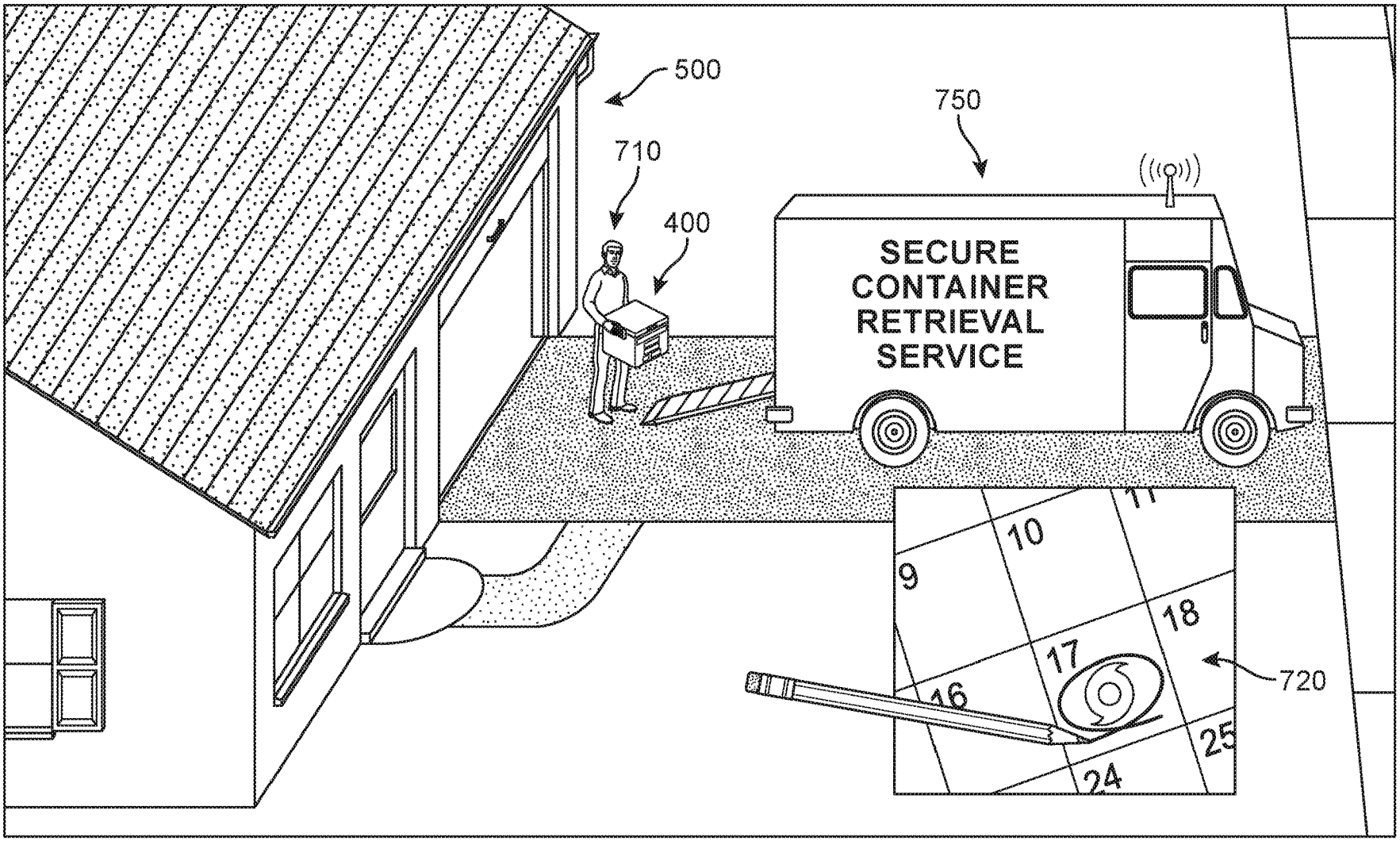
FIG. 7 is an illustration of a pick-up service retrieving the container prior to an emergency situation, according to an embodiment.

For purposes of illustration, some examples of a container retrieval service system ("system") are shown with reference to FIGS. 7-10. In FIG. 7, a first transport vehicle ("first vehicle") 750 has arrived at the residence 500 where container 400 is located. In some embodiments, the system can initiate a preparatory action in anticipation of an emergency situation, based on the location data and the forecast data, and executing the preparatory action at a predetermined time relative to the predicted time of occurrence of the predicted disaster. For example, the system may be configured to dispatch first vehicle 750 within two days (or some other window) of an approaching storm that is forecast to cause massive flooding in a region where a secure container is located. In some cases, the preparatory action may include coordinating an order of an employee or other agent 710 to retrieve the container 400 via first vehicle 750. In some embodiments, first vehicle 750 may be a hauling vehicle, such as a shipping truck or cargo van. It will be noted that other types of pre-disaster preparatory actions may be taken that do not necessarily involve a vehicle. However, the dispatch of a vehicle is utilized to represent the execution of preparatory or responsive actions of the service generally.

It will be understood that, in different embodiments, the initial determination of the preparatory action may be based on the amount of time remaining until the disaster when the initial determination is made. The forecast may provide a longer or shorter lead time before the disaster occurs. Also, a user may register with the container retrieval service system well ahead of a predicted disaster, or shortly before the disclosed disaster. Accordingly, the amount of time remaining before the predicted occurrence of the disaster is considered when determining when the retrieval is scheduled. In some embodiments, the system may alter the preparatory action to be executed based on a change in the location data received from the personal electronic device of the user or based on a change in the forecast data received regarding the predicted disaster, as well as the presence of other containers in the area. For example, if the preparatory action is determined by the system and scheduled to be made 72 hours before the disaster is forecast to begin, but 84 hours prior to the predicted disaster the forecast changes, the system may change the determined preparatory action. For instance, if the initial forecast called for a very severe storm, and recommendations were for the local residents to evacuate the area, the initial determination may have been for a relatively substantial preparatory action (e.g., it may be recommended to move any container from their residence). If the forecast changes, and the storm is not predicted to be as severe in the user's locality, the recommended preparatory action may be less substantial (e.g., it may be recommended to only move the container to a higher level in the home to avoid minor flooding). The opposite change may also be made. That is, if the forecast changes to a more severe disaster, the preparatory action to be made may be changed to be more substantial instead of less substantial. Further, the preparatory action may include coordinating an order, including determining a size of a vehicle based, at least in part, on the container profile.

Figure 8:
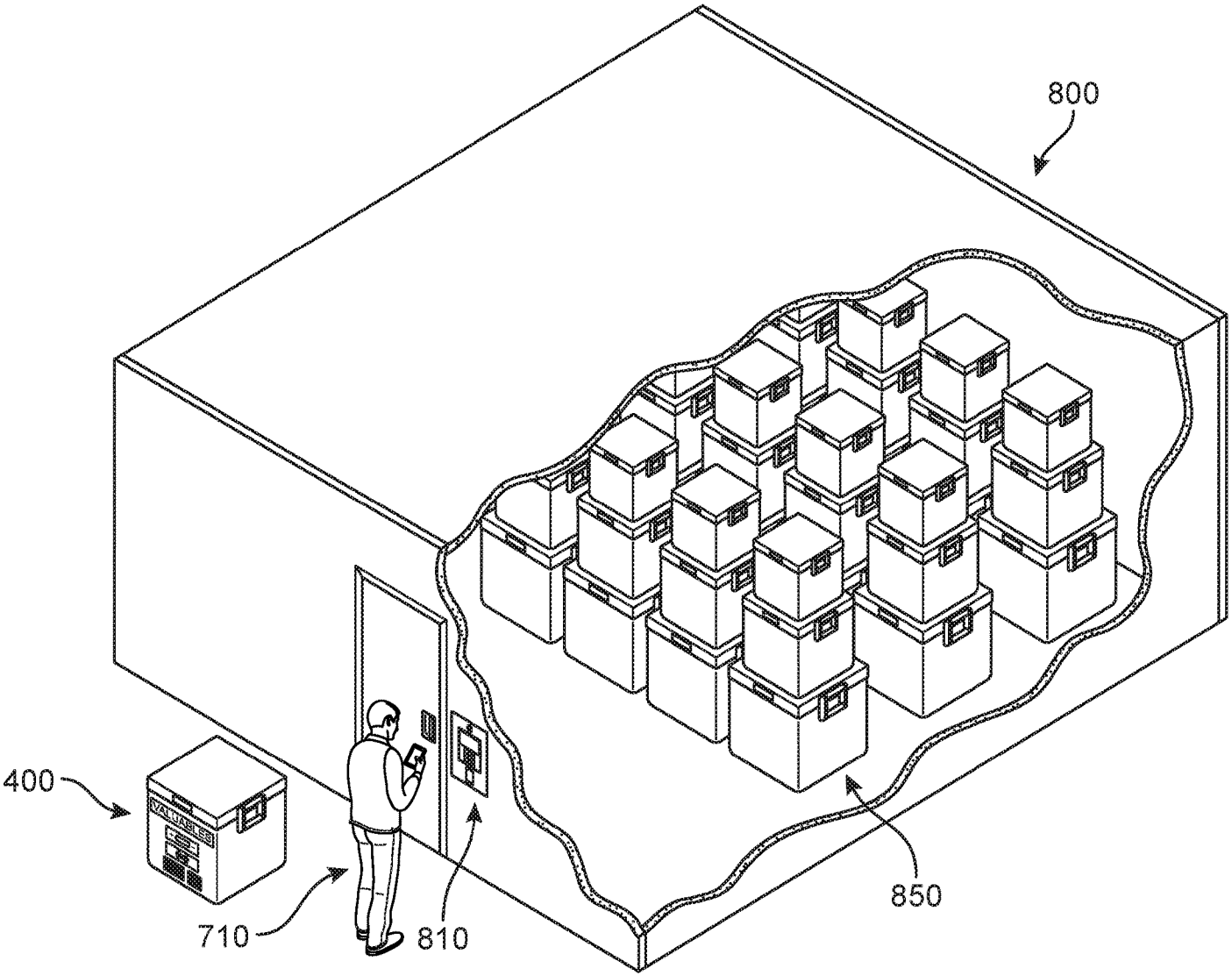
FIG. 8 is a cut-away view of a secure storage facility for the storage of containers, according to an embodiment.

FIG. 8 illustrates an example of a container secure storage facility ("facility") 800 where containers 850 of various sizes and types, from various pick-up locations, can be stored and protected. The facility 800 can be a standalone or self-contained structure, above ground and/or underground, or may be part of another building, typically including insulation and an HVAC system for controlling the temperature inside the container at a reasonably comfortable temperature for the protection of valuables. The facility 800 can further include an authorized user interface 810 outside the door to verify that agent 710 is authorized to enter facility as well as a container scanning device to record the entry and exit of containers. The facility may be located in the region where the emergency situation is to occur, or outside of that region. Security cameras can also be installed in the facility 800 and transport vehicles to maintain a record of visitors and container movement.

In some cases, disasters may not be predictable, or any information about an impending disaster is not sufficiently timely or is too dynamic to reliably determine that retrieval is warranted. In some other cases, the disaster may cause damage of roadways or other transportation avenues that delay the retrieval of the container. Thus, there may be situations where a container remains in its original location during and after a disaster in the region. However, as soon as it becomes feasible to do so, the container retrieval service can dispatch a vehicle to the container location. In some cases, the container may remain at its original location following the disaster. However, in other cases, the location may have sustained significant impact from the disaster and caused a displacement of the container.

Figure 9:
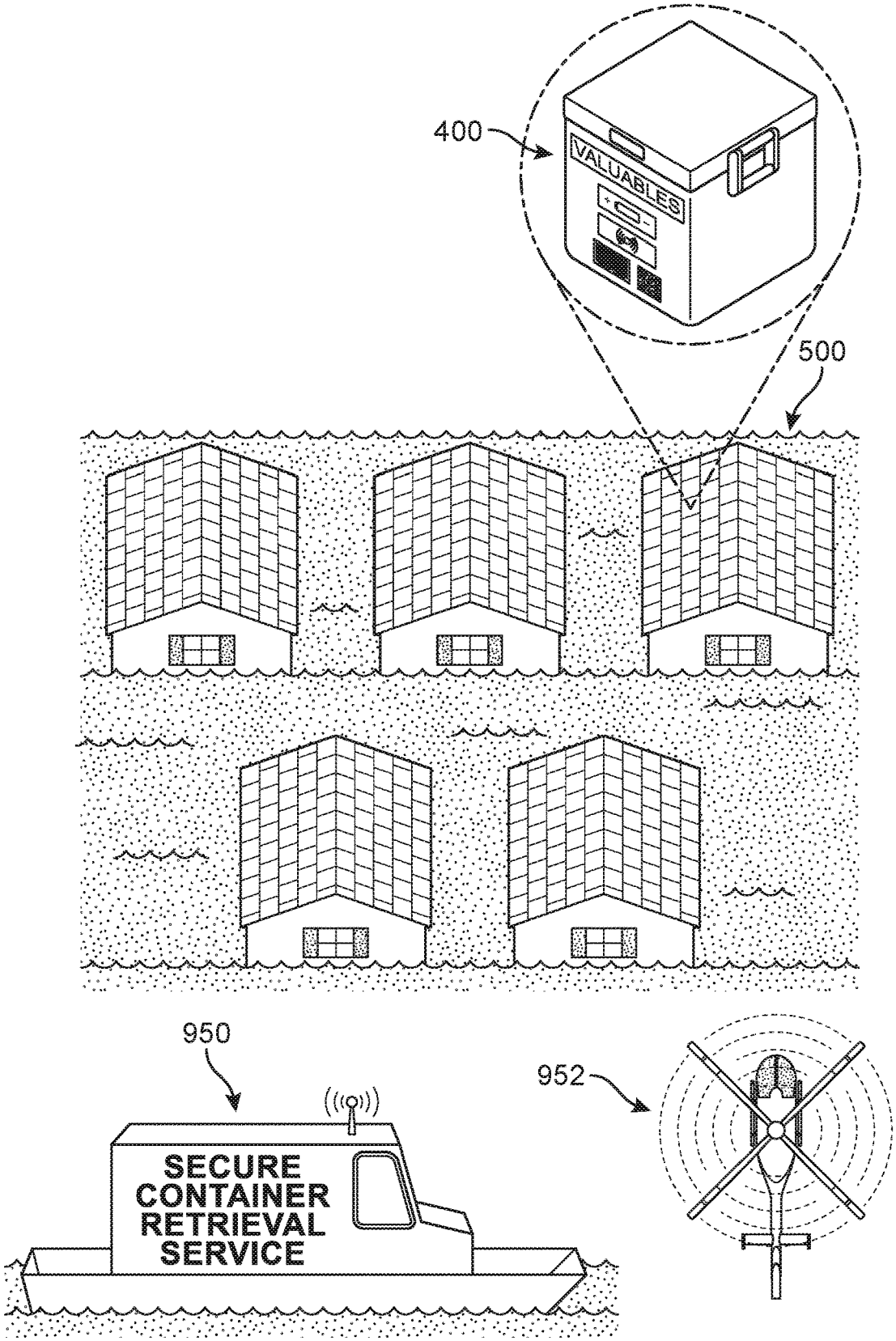
FIG. 9 is a bird's-eye view of a pick-up service retrieving the container in response to an emergency situation, according to an embodiment.
Figure 10:
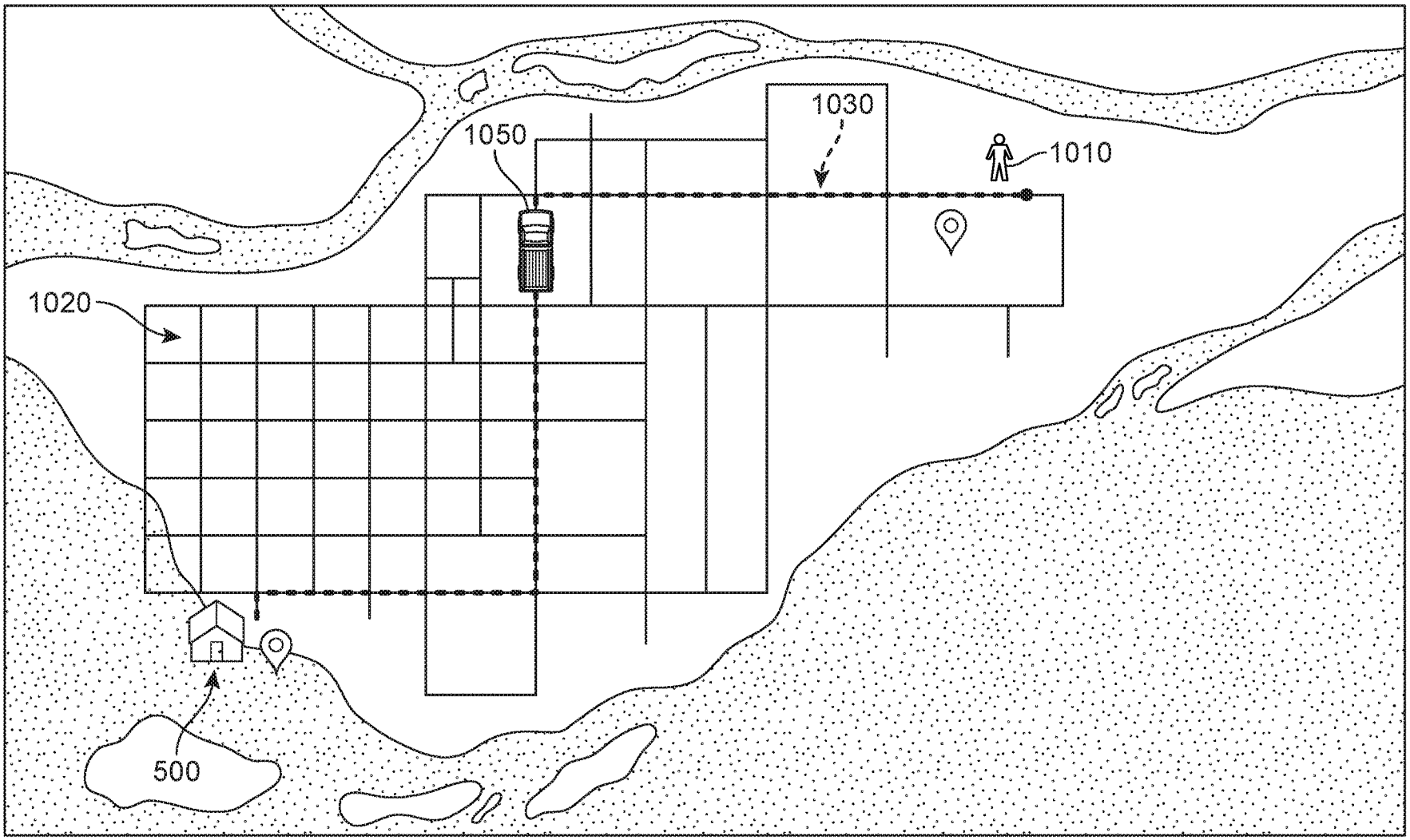
FIG. 10 is a schematic diagram of a rescue route recorded by the container to facilitate location of a person, according to an embodiment.

In FIG. 9, an example of vehicles having been dispatched to retrieve container 400 from residence 500 is depicted. In this example, a neighborhood 900 has been affected by a large flood, such that most of the homes are at least partly submerged, including residence 500 where container 400 is stored. In response to a signal emitted by a tracking device associated with the container 400, various types of transport vehicles can be dispatched to retrieve the container 400. For purposes of illustration, an air-transport vehicle 952 such as a drone, helicopter, airplane, or seaplane and/or a water transport vehicle 950 such as a boat or seaplane can be sent to the residence 500. This can also be implemented in cases where the signal indicates the container 400 has moved (for example, downriver) and the vehicles can navigate to the new target location. The container 400 and its contents can be recovered and moved to a secure facility until the owner is ready and able to pick up the container.

In other embodiments, the container may not include a tracking device, but instead the container profile may inform the system where the container is and/or where a container owner is located. In some embodiments, the container can include a beacon that emits a signal providing a map or directions to the container and/or person. One example of this is presented with reference to FIG. 10, where a second vehicle 1050 has been dispatched to recover a container following a disaster. The container location was originally recorded on the container profile as being stored in residence 500, but the profile has been updated and/or the beacon signal now indicates that the retrieval service should navigate to a different, safe location 1010. A route 1030 has been stored in the profile and/or the container beacon, and the second vehicle 1050 can travel through the damaged neighborhood 1020 to reach the safe location 1010. In some embodiments, the container owner can thereby provide a means of telling the service where he or she will be going to evacuate from the disaster, and employ the service as a means of ensuring someone will be able to locate him or her.

Figure 11:
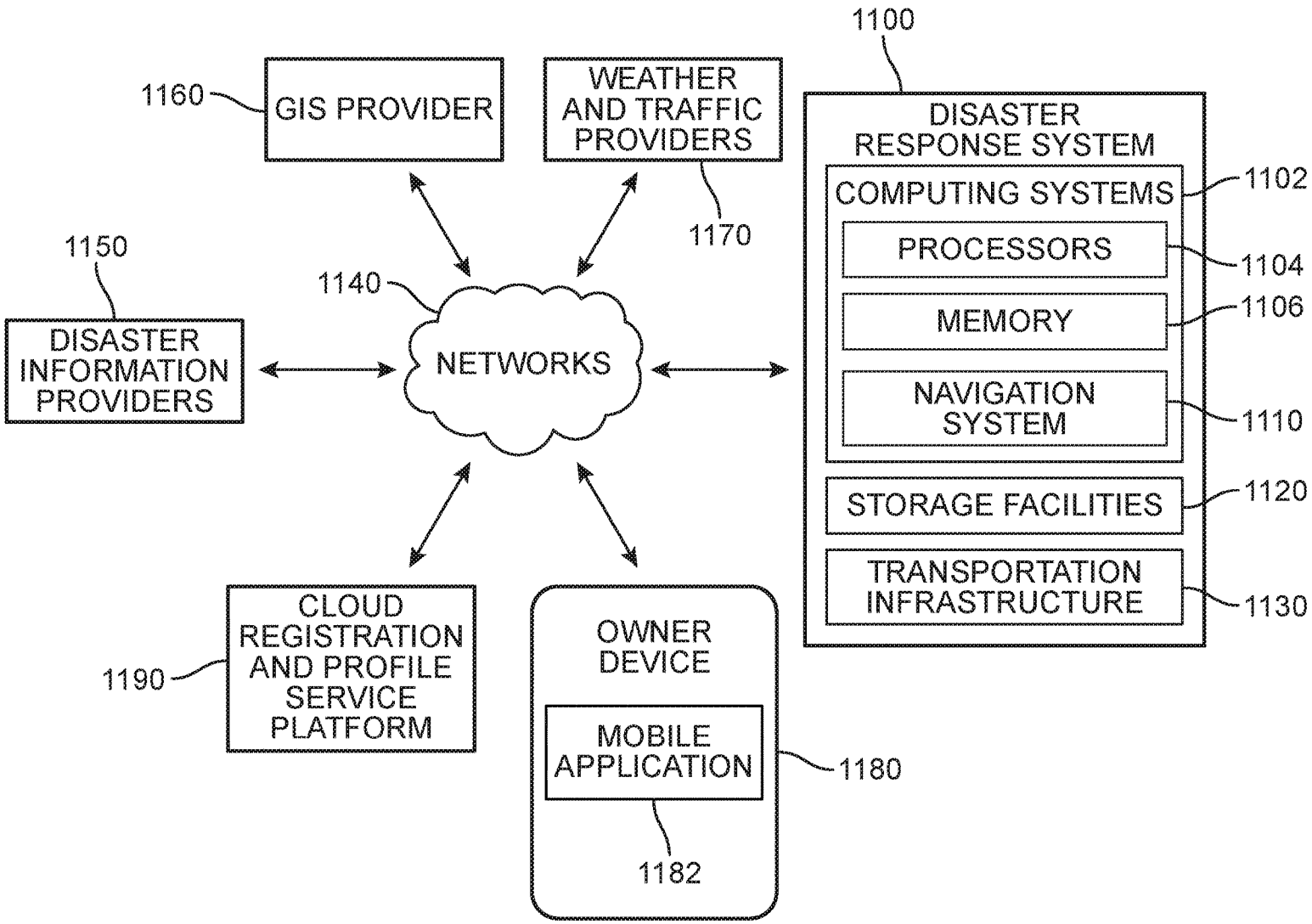
FIG. 11 is a schematic view of a container retrieval service system and associated parties, according to an embodiment.

FIG. 11 is a schematic view of a container retrieval service system ("CRS system") 1100 for securing containers belonging to residents (or other occupants) of a geographic area before, during, or following a disaster (or emergency). Disasters may include natural disasters, such as wildfires, floods, tornados, hurricanes, blizzards, and earthquakes, as well as man-made disasters such as house/building fires and mass shootings. As used herein, the term "resident" refers to any person living in, or otherwise temporarily residing in, a particular geographic area.

CRS system 1100 includes a computing system 1102. Computing system 1102 may comprise a server, a cluster of servers, or any suitable configuration of computing resources including one or more processors 1104 and memory 1106. Memory 1106 may comprise a non-transitory computer readable medium. Instructions stored within memory 1106 may be executed by the one or more processors 1104.

Computing system 1102 may also include a navigation system 1110. Navigation system 1110 may be used for one or more purposes. For example, navigation system 1110 may be used to look up addresses. Navigation system 1110 may also be used to acquire directions to one or more addresses. Navigation system 1110 may also be used to convert geographic locations provided in one format (for example, a set of GPS coordinates) to other location formats (such as a street address).

CRS system 1100 may also include storage facilities 1120 and a transportation infrastructure 1130. As described in further detail below, one purpose of CRS system 1100 is to dispatch vehicles and agents to retrieve containers using transportation infrastructure 1130 to residents who have evacuated their residences because of a disaster or other emergency and secure the containers in storage facilities 1120.

The CRS system 1100 may communicate with various other systems over one or more networks 1140. Examples of networks that may be used to facilitate communication between different systems include, but are not limited to: Wi-Fi networks, cellular networks, local area networks (LANs), wide area networks (WANs), personal area networks (PANs), as well as any other suitable networks.

The CRS system 1100 may communicate with one or more disaster information providers 1150. As used herein, the term "disaster information provider" refers to any entity that may transmit information about pending or ongoing disasters. As an example, the Emergency Alert System (EAS) is a federal system used in the United States to provide emergency notifications, including emergency weather alerts for specific geographic areas. In other embodiments, disaster information providers 1150 could include any other organization (private or public) configured to deliver information about pending or ongoing disasters or emergencies. Alerts can be provided over any communication mode, including short messaging service (SMS) based texts, emails, or other suitable communication modes.

In addition, CRS system 1100 may also communicate with a Geographic Information System (GIS) provider 1160. For example, CRS system 1100 could retrieve maps and other related geographic information from GIS provider 1160. Furthermore, CRS system 1100 may also communicate with weather and traffic providers 1170. Specifically, CRS system 1100 may receive real-time or near real-time information about weather and traffic in specific geographic locations. In some cases, real-time traffic information may include information about road closures in an area.

In some embodiments, CRS system 1100 may communicate with residents through one or more devices. As an example, a resident-container owner device ("device") 1180 is shown schematically in FIG. 11. The devices may be owned by residents in a particular geographic region. In one embodiment, the device 1180 may run an application 1182 for communicating information between CRS system 1100 and a resident. Device 1180 could include computing resources such as processors, memory, and a navigation system for detecting a current GPS location. Device 1180 may comprise mobile phones, tablets, smart watches or other mobile devices.

Furthermore, as shown in FIG. 11, the CRS system 1100 may be in communication with or include a cloud registration and profile platform application service ("application") 1190. The application 1190 is configured to enable container registrations, generate user accounts and profiles, receive and store information provided by a user about a container, link various user identity data with specific containers, provide user interfaces for the benefit of the user, allow a user to modify or update profile information and communicate with the facility where a container is stored, schedule pick-ups or deliveries, and/or order, rent, or purchase containers. In some embodiments, the application 1190 can also serve as a database for the CRS system 1100 to help determine when a particular response, such as a container retrieval, is to be initiated, as well as the preferences of the user when implementing the response.

Figure 12:
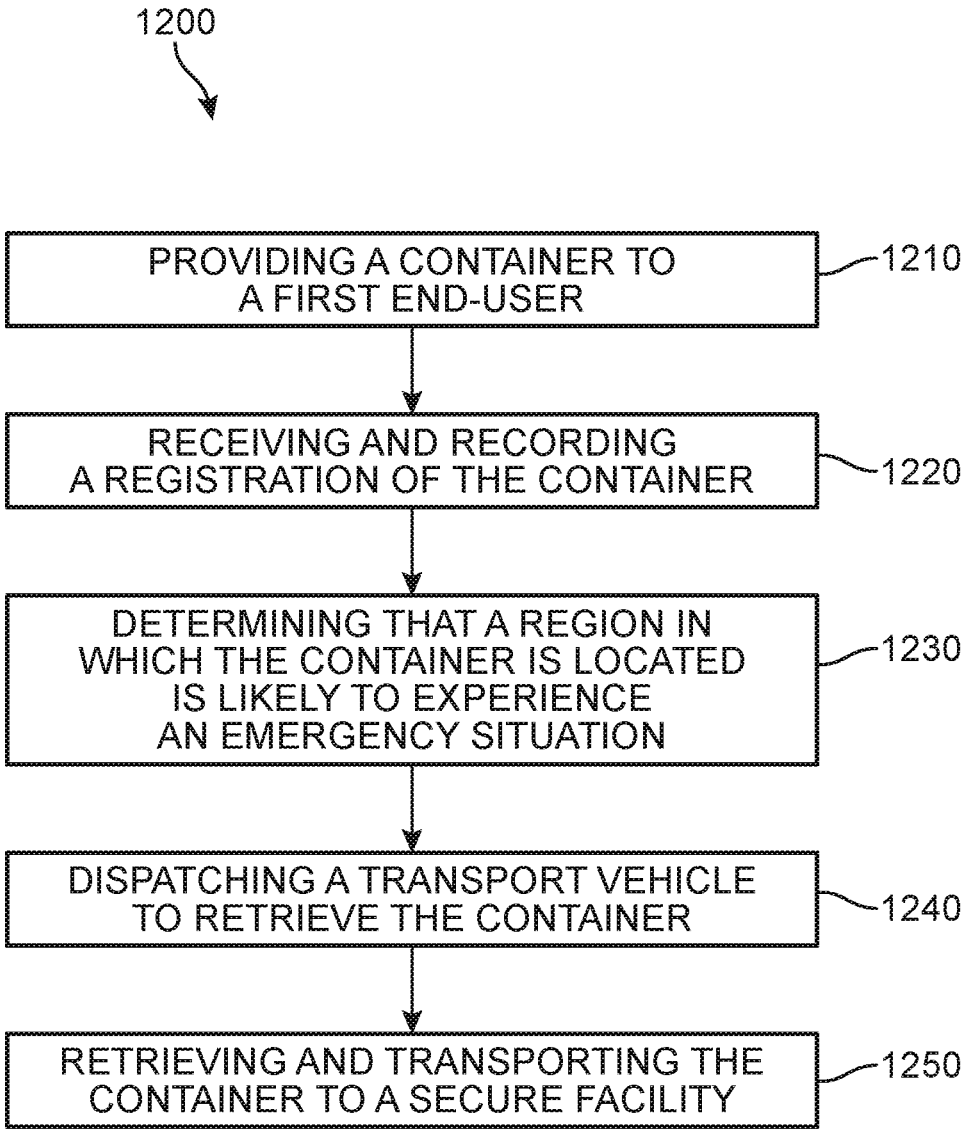
FIG. 12 is a flow chart of a process of securing valuables stored in a container, according to an embodiment.

FIG. 12 is a flow chart illustrating an embodiment of a method 1200 of securing items in anticipation of a disaster. The method includes a first step 1210 of providing a container to a first end-user. For example, the container may be purchased by the user in a retail store or through an online vendor, or the container can be distributed by a government or other humanitarian agency. A second step 1220 includes receiving and recording a registration of the container from the first end-user. The registration can link the identity of the user with the container. For example, container indicia or markings can be scanned and stored in conjunction with user identity information, tokens, and/or biometric recognition data. Furthermore, the registration can allow a user to create a container profile for adding detail about the container, add or modify a listing of persons authorized to access and/or take custody of the container, preferences regarding the retrieval and recovery of the container, an address or other location details of the container, and other notes. A third step 1230 includes determining that a region in which the container is located is likely to experience an emergency situation. A fourth step 1240 includes dispatching a transport vehicle to a first location to pick up and retrieve the container. In some embodiments, this response can be triggered automatically by the system following the determination that a disaster is targeting a region where a registered container is located, and the timing of the retrieval can be determined by the safety of the roadways or other avenues of transit. The transport vehicle can be a truck, van, boat, drone, or helicopter, or other suitable vehicle. Furthermore, in some embodiments, the vehicle can be selected based at least in part on the approximate size and weight of the container (as described in the container profile).

In cases of some natural disasters, it may be possible to learn in advance that the disaster is to occur, and for the retrieval to occur prior to the disaster. In other cases, the disaster may be unexpected, or there may not be sufficient warning prior to the impact of the disaster to retrieve the container. In such cases, the user(s) may evacuate the residence and leave the container, and the vehicle can make its way to the container once the roadways or other avenues of transportation permit such a recovery. A fifth step 1250 includes retrieving and then transporting the container to a secure facility designed to protect and safeguard the container, and ensure that the container is out of danger and in a known location where the user can easily recover the contents. In some embodiments, the secure storage facility is located outside the region affected by the disaster, while in other examples, the facility can be in a building that is designed to readily withstand the impact of the disaster event.

In other embodiments, the method may include additional steps or aspects. In one embodiment, the registration includes information about the container's location and an identity of an owner of the container. In some cases, the information includes an address of the container, and the first location corresponds to the address. In another embodiment, the secure facility is located outside the region that is to be affected by the emergency situation.

In some embodiments, the method can further include receiving a telemetry signal from a tracking device installed in the container, and the first location corresponds to a current location of the container as determined by the telemetry signal. In one embodiment, the method also includes steps of receiving a set of coordinates corresponding to the container's current GPS location from a tracking device installed in the container, where the first location is an address selected based on the current GPS location of the container.

In another example, the method also includes steps of determining that the region is no longer impacted by the emergency situation, and then initiating a response whereby the container is returned to the owner. For example, a request may be automatically generated to dispatch a second vehicle to recover the container from the secure facility and return it to a location designated by the owner (e.g., via the container profile). In some embodiments, the container may be returned to the first location after an assessment that the region is no longer in harm's way.

In another example, the method can include receiving a list of persons authorized to take custody of the container. This list can include the first end-user and a second end-user, such as a family member, friend, or business partner, as well as others. The list can also include verification information to ensure the individuals are correctly identified. The method can also include steps of receiving a request from a second end-user to take custody the container, determining that the second end-user is included in the list, and providing the container to the second end-user.

In some embodiments, the method may also include receiving a signal from a beacon device installed in the container (such as a homing or GPS signal), where the first location corresponds to a location of the container as described by the signal. In another example, the method may include receiving and recording the registration during an online purchasing session of the container by the first end-user. Furthermore, the method can include steps of presenting a registration interface to the first end-user on a display of a computing device associated with the first end-user, receiving a series of inputs from the first end-user through the registration interface, and generating and recording a container profile based on the series of inputs. The container profile can be later accessed, viewed, and modified by the user online.

It may therefore be appreciated that the embodiments provide a container for securing/protecting items in a disaster. The container can provide water and fire protection (via one or more fireproof and/or waterproof layers), security (via a locking mechanism), easy identification (via QR codes, for example), charging capabilities (via solar panels and/or onboard batteries), and tracking capabilities (via a tracking beacon). The container can be registered with a retrieval service that will deploy a vehicle to recover the container in the event of a disaster and store the container in a safe storage facility. The registration can allow the user to generate a profile describing the container and the identity of the user, persons authorized to access the container, and the user's preferences. Some embodiments may incorporate each of these features, while others could incorporate selective features.

The processes and methods of the embodiments described in this detailed description and shown in the figures can be implemented using any kind of computing system having one or more central processing units (CPUs) and/or graphics processing units (GPUs). The processes and methods of the embodiments could also be implemented using special purpose circuitry such as an application specific integrated circuit (ASIC). The processes and methods of the embodiments may also be implemented on computing systems including read only memory (ROM) and/or random access memory (RAM), which may be connected to one or more processing units. Examples of computing systems and devices include, but are not limited to: servers, cellular phones, smart phones, tablet computers, notebook computers, e-book readers, laptop or desktop computers, all-in-one computers, as well as various kinds of digital media players.

The processes and methods of the embodiments can be stored as instructions and/or data on non-transitory computer-readable media. The non-transitory computer readable medium may include any suitable computer readable medium, such as a memory, such as RAM, ROM, flash memory, or any other type of memory known in the art. In some embodiments, the non-transitory computer readable medium may include, for example, an electronic storage device, a magnetic storage device, an optical storage device, an electromagnetic storage device, a semiconductor storage device, or any suitable combination of such devices. More specific examples of the non-transitory computer readable medium may include a portable computer diskette, a floppy disk, a hard disk, magnetic disks or tapes, a read-only memory (ROM), a random access memory (RAM), a static random access memory (SRAM), a portable compact disc read-only memory (CD-ROM), an erasable programmable read-only memory (EPROM or Flash memory), electrically erasable programmable read-only memories (EEPROM), a digital versatile disk (DVD and DVD-ROM), a memory stick, other kinds of solid state drives, and any suitable combination of these exemplary media. A non-transitory computer readable medium, as used herein, is not to be construed as being transitory signals, such as radio waves or other freely propagating electromagnetic waves, electromagnetic waves propagating through a waveguide or other transmission media (e.g., light pulses passing through a fiber-optic cable), or electrical signals transmitted through a wire.

Instructions stored on the non-transitory computer readable medium for carrying out operations of the present invention may be instruction-set-architecture (ISA) instructions, assembler instructions, machine instructions, machine dependent instructions, microcode, firmware instructions, configuration data for integrated circuitry, state-setting data, or source code or object code written in any of one or more programming languages, including an object oriented programming language such as Smalltalk, C++, or suitable language, and procedural programming languages, such as the "C" programming language or similar programming languages.

Aspects of the present disclosure are described in association with figures illustrating flowcharts and/or block diagrams of methods, apparatus (systems), and computing products. It will be understood that each block of the flowcharts and/or block diagrams can be implemented by computer readable instructions. The flowcharts and block diagrams in the figures illustrate the architecture, functionality, and operation of possible implementations of various disclosed embodiments. Accordingly, each block in the flowchart or block diagrams may represent a module, segment, or portion of instructions. In some implementations, the functions set forth in the figures and claims may occur in an alternative order than listed and/or illustrated.

The embodiments may utilize any kind of network for communication between separate computing systems. A network can comprise any combination of local area networks (LANs) and/or wide area networks (WANs), using both wired and wireless communication systems. A network may use various known communications technologies and/or protocols. Communication technologies can include, but are not limited to: Ethernet, 802.11, worldwide interoperability for microwave access (WiMAX), mobile broadband (such as CDMA, and LTE), digital subscriber line (DSL), cable internet access, satellite broadband, wireless ISP, fiber optic internet, as well as other wired and wireless technologies. Networking protocols used on a network may include transmission control protocol/Internet protocol (TCP/IP), multiprotocol label switching (MPLS), User Datagram Protocol (UDP), hypertext transport protocol (HTTP), hypertext transport protocol secure (HTTPS) and file transfer protocol (FTP) as well as other protocols.

Data exchanged over a network may be represented using technologies and/or formats including hypertext markup language (HTML), extensible markup language (XML), Atom, JavaScript Object Notation (JSON), YAML, as well as other data exchange formats. In addition, information transferred over a network can be encrypted using conventional encryption technologies such as secure sockets layer (SSL), transport layer security (TLS), and Internet Protocol security (Ipsec).

While various embodiments of the invention have been described, the description is intended to be exemplary, rather than limiting, and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. A method of securing items in anticipation of a disaster, the method comprising:

providing a container to a first end-user;

receiving and recording a registration of the container from the first end-user;

determining that a region in which the container is located is likely to experience an emergency situation;

dispatching a transport vehicle to a first location to retrieve the container; and retrieving and transporting the container to a secure facility designed to protect and safeguard the container.

2. The method of claim 1, wherein the registration includes information about the container's location and an identity of an owner of the container.

3. The method of claim 1, wherein the secure facility is located outside the region that is to be affected by the emergency situation.

4. The method of claim 1, further comprising:

receiving a telemetry signal from a tracking device installed in the container; and wherein the first location corresponds to a current location of the container as determined by the telemetry signal.

5. The method of claim 1, further comprising:

determining that the region is no longer impacted by the emergency situation; and returning the container to the first location.

6. The method of claim 2, wherein the information includes an address of the container, and the first location corresponds to the address.

7. The method of claim 1, further comprising:

receiving a list of persons authorized to take custody of the container, the list including the first end-user and a second end-user;

receiving a request from a second end-user to take custody the container;

determining that the second end-user is included in the list; and providing the container to the second end-user.

8. The method of claim 1, further comprising:

receiving a signal from a beacon device installed in the container; and wherein the first location corresponds to a location of the container as described by the signal.

9. The method of claim 1, further comprising receiving and recording the registration during an online purchasing session of the container by the first end-user.

10. The method of claim 1, further comprising:

presenting a registration interface to the first end-user on a display of a computing device associated with the first end-user;

receiving a series of inputs from the first end-user through the registration interface; and generating and recording a container profile based on the series of inputs.

11. A system for protecting a container located in a region that is likely to be affected by a disaster, the system comprising:

a processor;

machine-readable media including instructions which, when executed by the processor, cause the processor to:

receive and record a registration of the container from the first end-user;

receive information about a disaster in the region; and dispatch a transport vehicle to a first location to retrieve and transport the container to a secure facility designed to protect and safeguard the container.

12. The system according to claim 11, wherein the transport vehicle is a truck, van, boat, drone, or helicopter.

13. The system according to claim 11, wherein the secure storage facility is located outside the region affected by the disaster.

14. The system of claim 11, wherein the transport vehicle is dispatched in advance of an occurrence of the disaster.

15. The system of claim 11, wherein the transport vehicle is dispatched following the occurrence of the disaster.

16. The system of claim 11, wherein the instructions further cause the processor to:

receive a set of coordinates corresponding to the container's current GPS location from a tracking device installed in the container; and wherein the first location is an address selected based on the current GPS location of the container.

17. The system of claim 11, wherein the registration includes a description of an approximate size and weight of the container, and the transport vehicle is selected based at least in part on the approximate size and weight of the container.

18. The system according to claim 11, wherein the registration includes information about the container's location and an identity of an owner of the container.

19. The system according to claim 18, wherein the information includes an address of the container, and the first location corresponds to the address.

20. The system according to claim 11, wherein the instructions further cause the processor to:

receive a list of persons authorized to take custody of the container;

receive a request from an end-user to take custody the container;

determine that the end-user is included in the list; and permit access of the container to the end-user.

* * * * *